United States Patent [19]

Kashiwara et al.

[11] Patent Number: 4,983,877

[45] Date of Patent: Jan. 8, 1991

[54] IGNITION PLUG FOR USE IN INTERNAL COMBUSTION ENGINES TO CAUSE INSTANTANEOUS COMBUSTION

[76] Inventors: Ryohei Kashiwara, Raitsu Ootori 106, 456-1, Ootori-kitamachi 8-cho, Sakai-shi, Osaka-fu; Hideaki Kashiwara, 3-B, 611, 151-30, Ninomaru-cho Mukojima, Fushimi-ku, Kyoto-shi; Hidehiko Noguchi, 7-14, Taiho 3-chome, Kanan-cho, Minami-kawachi-gun, Osaka-fu; Takeaki Kashiwara, 3,37-411, Nagayoshidedo 3-chome, Hirano-ku, Osaka-shi, all of Japan

[21] Appl. No.: 333,038

[22] Filed: Apr. 4, 1989

[30] Foreign Application Priority Data

Apr. 12, 1988 [JP] Japan ..... 63-89681

[51] Int. Cl.[5] ..... H01T 13/32; H01T 13/46

[52] U.S. Cl. ..... 313/140; 313/141; 313/142

[58] Field of Search ..... 313/141, 140, 142

[56] References Cited

U.S. PATENT DOCUMENTS

| | | | |
|---|---|---|---|
| 1,224,296 | 5/1917 | Gibson | 313/140 X |
| 1,298,368 | 3/1919 | Metzinger | 313/142 X |
| 1,360,294 | 11/1920 | Hill | 313/139 X |
| 1,371,488 | 3/1921 | Jacobson | 313/139 |
| 1,659,037 | 2/1928 | MacDonald | 313/141 |
| 2,129,003 | 9/1938 | Grant | 313/139 X |
| 2,391,459 | 5/1944 | Hensel | 313/139 |
| 2,616,407 | 11/1952 | Thomas | 313/145 X |
| 2,944,178 | 9/1956 | Schaub | 313/141 |
| 3,313,972 | 4/1967 | Beesch | 313/130 |
| 3,970,885 | 7/1976 | Kasima | 313/141 |
| 4,023,058 | 5/1977 | Lara et al. | 313/139 |
| 4,123,998 | 11/1978 | Heintzelman | 313/143 X |
| 4,336,477 | 6/1982 | Yamada | 313/142 |
| 4,401,915 | 8/1983 | Kashiwara et al. | 313/142 |
| 4,808,878 | 2/1989 | Kashiwara et al. | 313/141 |
| 4,851,732 | 7/1989 | Kashiwara et al. | 313/141 |

FOREIGN PATENT DOCUMENTS

| | | |
|---|---|---|
| 2479588 | 10/1981 | France . |
| 87331 | 12/1976 | Japan . |
| 25743 | 3/1978 | Japan . |
| 60212989 | 9/1978 | Japan . |
| 123080 | 7/1985 | Japan . |
| 30394 | 12/1986 | Japan . |
| 11471 | 12/1987 | Japan . |
| 62-335923 | 12/1987 | Japan . |
| 187501 | 10/1922 | United Kingdom . |

*Primary Examiner*—Palmer C. DeMeo
*Attorney, Agent, or Firm*—Fisher, Christen & Sabol

[57] ABSTRACT

Disclosed are two types of ignition plugs for use in internal combustion engines of automobiles and the like, which are essentially characterized by the addition of ignition means to conventionally paired center and ground electrodes, and their location to the latters; that is, both the ignition plugs are designed to ignite gas mixture in the whole space of combustion chamber by firstly igniting gas mixture in an ignition groove on the ignition means; for this, the opening of the groove is located in such a place as to receive first ignition seeds appearing in a spark gap between center and ground electrodes as effectively as possible.

14 Claims, 11 Drawing Sheets

IGNITION PLUG FOR USE IN INTERNAL COMBUSTION ENGINES TO CAUSE INSTANTANEOUS COMBUSTION

FIELD OF THE INVENTION

This invention relates to an ignition plug for use in internal combustion engines of automobiles and the like.

BACKGROUND OF THE INVENTION

The inventors have developed an ignition plug disclosed in Japanese patent application publication No. sho 62-11471. In the ignition plug, an ignition groove is provided on one side of a ground electrode opposite a center electrode in such a way that a gas mixture in the groove may be ignited by ignition seeds in the spark gap so as to prompt combustion in the combustion chamber.

However, it has become clear that with this system, no more powerful initial ignition can be hoped for even if more than one ground electrode, each provided with the ignition groove, would be disposed around the center electrode. It is because with this old system, such sparks as leading to the ignition of gas mixture in the groove would not appear in the respective spark gaps at the same moment, but only in any one of them every combustion cycle.

SUMMARY OF THE INVENTION

In view of the above, the inventors made intensive studies to improve the old system and succeeded in completing two types of new ignition plugs by accomplishing this invention. That is, one is an ignition plug, characterized in that a plurality of ignition means are held by metal casing part of which forms a ground electrode, an ignition groove is provided on the side of the ignition means opposite a center electrode, and all gaps between the center electrode and the free end of the ignition means, on which the opening of the respective ignition grooves is equally directed to a spark gap, are made the same and greater than the spark gap. The ignition means and the ground electrode are all inwardly bent into an L-shape so that all their horizontal top portions are at right angles to the axial line of the center electrode, and spaced apart at the same angular interval around the center electrode. The shape of the center electrode is straight and cylindrical, the spark gap is formed between the top face of the center electrode and the horizontal top portion of the L-shaped ground electrode which is made larger, in both its length and width, than the diameter of the center electrode. Like this, in the first type of the ignition plug all of the free ends of the respective ignition means are spaced the same distance from the center electrode, and all of the ignition grooves of the respective ignition means are equally directed to the spark gap; therefore, the ignition plug enables gas mixture in all of the ignition grooves to take fire in the same moment even by a single ignition seed in the spark gap, and the performance of the ignition plug can be varied by reducing or increasing the number of ignition grooves to comply with the size and shape or the displacement of internal combustion engines to be used.

The other is an ignition plug, characterized in that an ignition means is held by a center electrode, and an ignition groove is provided on the other side of the ignition means opposite the center electrode, wherein the ignition means is straight and mounted on the top of the center electrode at the middle thereof in a T-form in such a way that the ignition groove faces a ground electrode, the shape of the center electrode is straight and cylindrical, and the ground electrode is inwardly bent into an L-shape so that the horizontal top portion thereof is at right angles to the axial line of the center electrode, and the ignition means and the ground electrode are disposed at right angles to each other with a spark gap in between.

As seen from the above, in the second type of the ignition plug, the ignition groove under the center electrode has a considerably larger capacity to hold gas mixture in, and faces the ground electrode, so that gas mixture in it can be ignited in a moment with a great strength, and the ignition power can be increased or decreased at will by changing the capacity of the ignition groove.

In the meantime, the ignition means on the back of which is the ignition groove is formed from the metal casing as a part of thereof, or attached to the top face of the center electrode in this invention, but where the ignition means is provided, is within the spirit of this invention according to circumstances.

Accordingly, it is an object of this invention to provide an ignition plug capable of giving internal combustion engines a powerful output by the addition of one or more than one ignition means to center and ground electrodes, and its/their proper location to the latters.

BRIEF DESCRIPTION OF THE DRAWINGS

The above and other objects and features of this invention will appear more fully hereinafter from a consideration of the following description taken in connection with the accompanying drawings, in which.

DETAILED DESCRIPTION OF THE INVENTION

Figure 1:
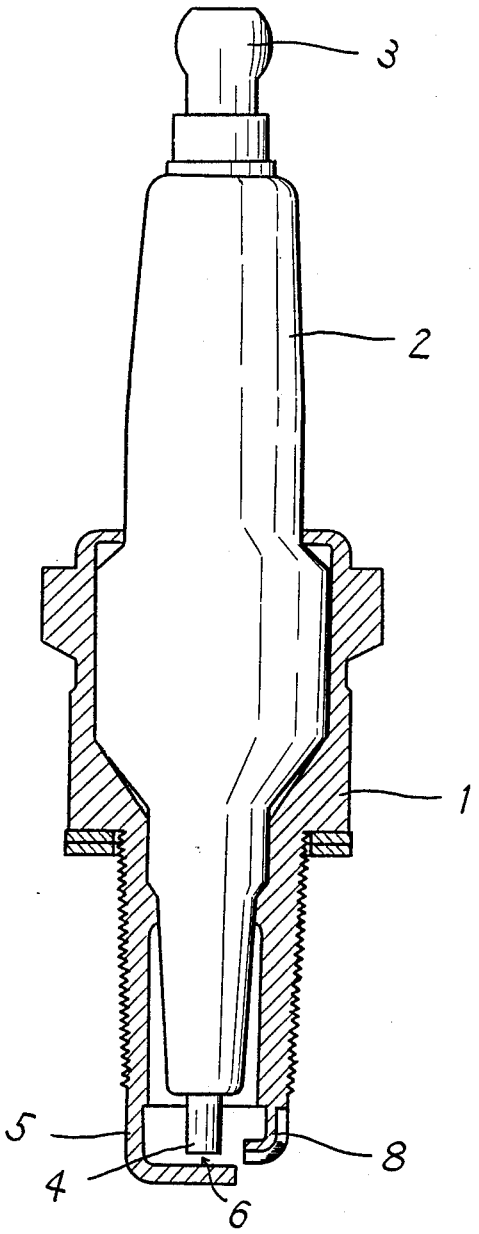
FIG. 1 is an elevational whole view of the first example of an ignition plug of this invention.

As shown in FIGS. 1 through 4, the first example of an ignition plug of this invention is constructed essentially of a piece of center electrode 4, a piece of ground electrode 5, and three pieces of ignition means 8. The center electrode 4, whose terminal end is numbered with 3, has a cylindrical shape, and is put in the core of, a porcelain insulator 2 covered with an electric conductive threaded metal casing 1. The ground electrode 5, which has a rectangular cross-section (FIG. 3), is formed from the metal casing 1, and inwardly bent into an L-shape in such a manner that the horizontal top portion is at right angles to the axial line of the center electrode 4, and parallel to the top face of the center electrode with a spark gap 6 in between. The ignition means 8 respectively provided with an ignition groove 7 are also formed from the metal casing 1, and inwardly bent into an L-shape in such a manner that the horizontal top portions are at right angles to the axial line of the center electrode 4 similarly.

Figure 2:
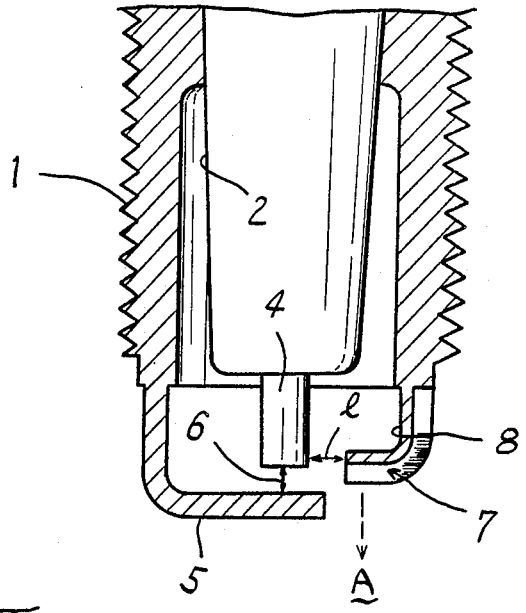
FIG. 2 is a partly enlarged elevational view of the top portion of the same shown in FIG. 1.
Figure 3:
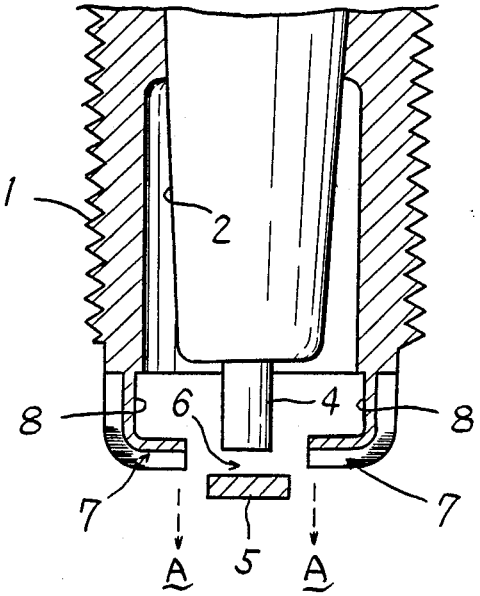
FIGS. 3 and 4 are a side view and a bottom view of the same shown in FIG. 2, respectively.

The ground electrode 5 and the ignition means 8 are radially disposed at the same angular interval around the center electrode 4. All of the free ends of the ignition means 8 on which the ignition grooves respectively open are correctly directed to the spark gap 6 as shown in FIGS. 2 and 3. Their distance (l) from the center electrode 4 is made all the same, and greater than the spark gap 6 in order that sparks may always appear in the spark gap 6. With this device, sparks do not appear in any space between the center electrode 4 and each free end of the ignition means 8.

Figure 4:
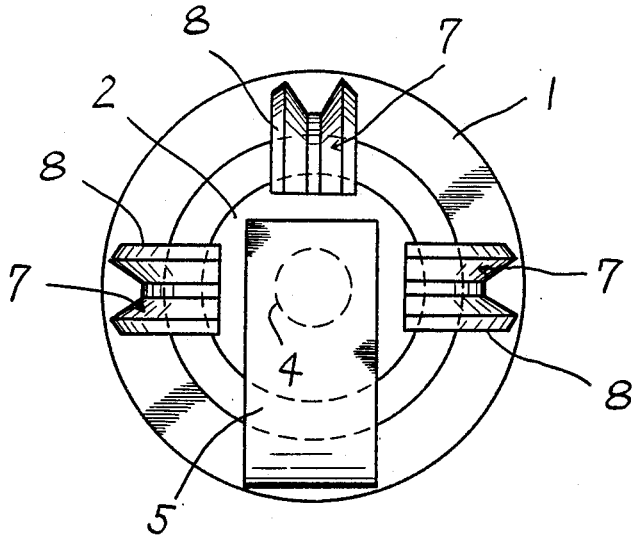
Figure 5:
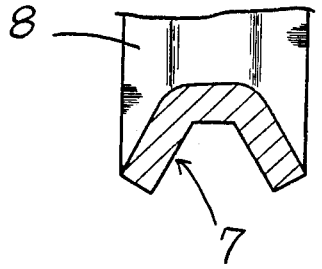
FIG. 5 is an enlarged cross-sectional view of an ignition groove on an ignition means.

Since the horizontal top portion of the L-shaped ground electrode 5, which is opposed to the top face of the center electrode 4 with the spark gap in between, is designed to be larger, in both its length and width, than the diameter of the center electrode as shown in the bottom view of FIG. 4, sparks appearing in the spark gap can instantaneously jump into the opening of the ignition grooves on the free ends of the ignition means 8 by the guide of the inside flat face of the ground electrode 5. In the meantime, this example shows that a frustum shaped ignition groove 7 is formed on the outside of the ignition means 8 by longitudinally bending projecting flat part of the metal casing 1, as shown in FIG. 5.

The first example of this invention is constructed such that when electric current is applied to the terminal 3, a high voltage is impressed between the center 4 and the ground 5 electrodes, and there appear sparks there, which ignite gas mixture compressed to just before its top dead center by a piston A (not shown here) spaced away from the other side (outside ) of the ground electrode in terms of the center electrode 4.

The ignition seeds firstly formed in this way jump into the opening of the ignition groove 7 on the free end of the ignition means 8 opposed to the spark gap 6 by the guide of the inside flat face of the ground electrode 5, and form there second ignition seeds greater than the first ones so as to set gas mixture on fire in the groove 7.

Combustion rapidly extends therefrom, by which gas mixture in the whole space of combustion chamber takes fire in a moment. The process from the generation of sparks to the completion of combustion is such that the time before combustion is reduced by the strengthened ignition, formation of incomplete combustion gas is controlled, and the output loss in the progress of piston's compression is declined, all of which lead to increasing the fuel efficiency.

As stated above, the first ignition seeds jump into each of the ignition grooves 7 almost at the same time, so that they can ignite all gas mixture in the three ignition grooves in as very short a moment as ignite gas mixture in one. Therefore, the initial expansion of combustion gas is strengthened by the three ignition grooves three times as much as by a single groove.

Figure 6:
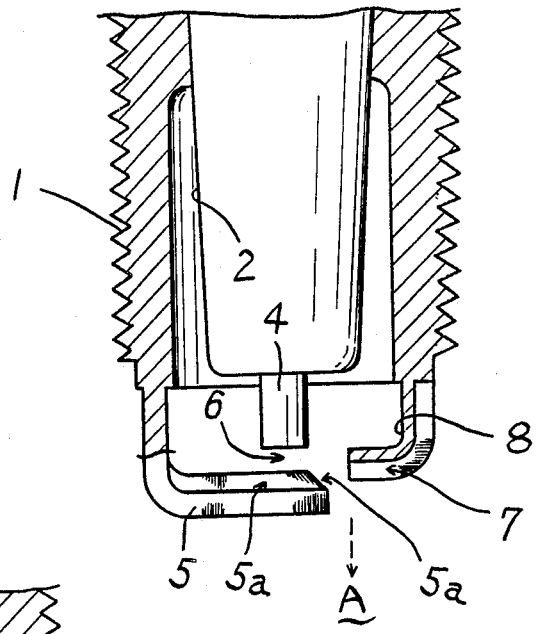
FIGS. 6 through 8 are an elevational view, a side view, and a bottom view of a modification of the first example, respectively.
Figure 7:
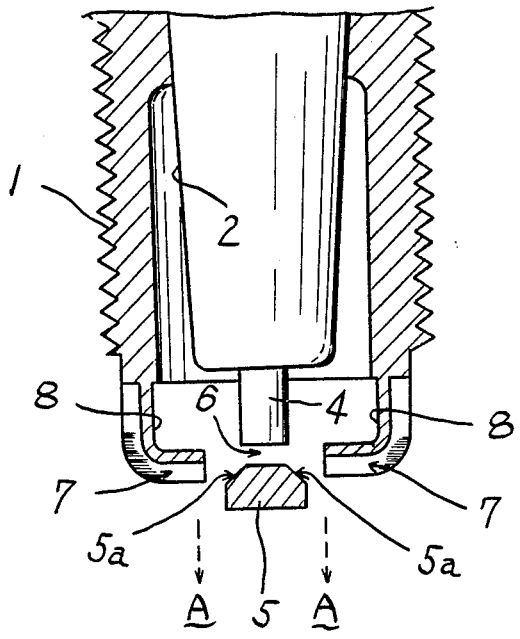
Figure 8:
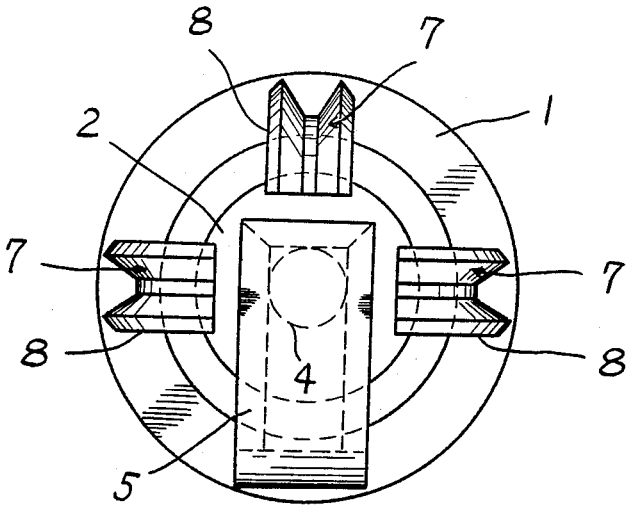
Figure 9:
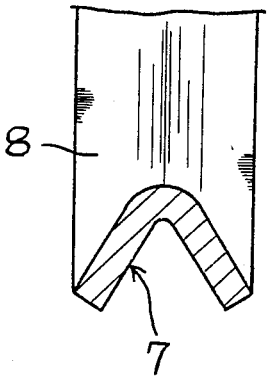
FIGS. 9 through 13 are an enlarged cross-sectional view of various ignition grooves.
Figure 10:
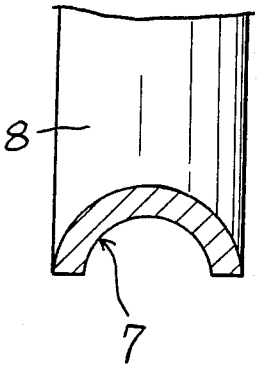
Figure 11:
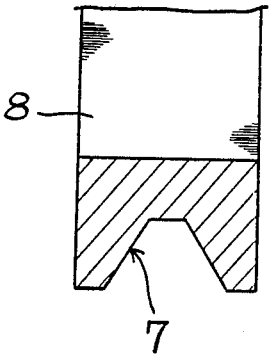
Figure 12:
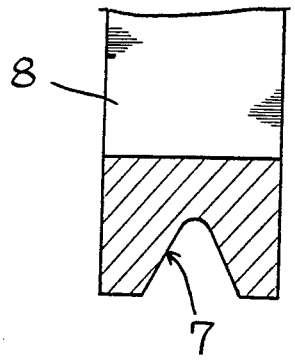
Figure 13:
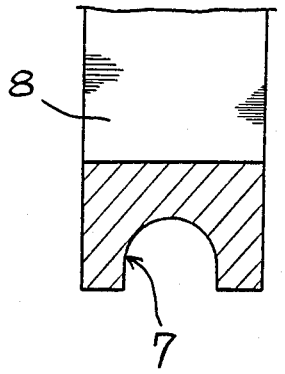

In a modification of the first example shown in FIGS. 6 through 8, the front edge and both the longitudinal edges of the ground electrode 5 are chamfered respectively in such a manner as to provide there an inclined face facing toward each ignition groove 7 of each ignition means 8. The inclined faces are formed in order to give first ignition seeds a bouncing means on the ground electrode before jumping into the ignition grooves 7 with, by which the ignition of gas mixture in the ignition grooves 7 is accelerated, and the time before combustion is reduced much more.

Modifications of the ignition grooves 7 on the back of the ignition means 8 are shown in FIGS. 9 through 13. It has already been described in connection with FIG. 5 that a frustum shaped ignition groove 7 is formed on the outside of the ignition means 8 by longitudinally bending projecting flat part of the metal casing 1. Likewise, a V-shaped or semi-circular shaped groove can be formed on the outside of the ignition means 8 in a similar manner. Other than that, the ignition means 8 can be formed into a square solid prism, for example, and a frustum shape (FIG. 11), V-shape (FIG. 12), or semi-circular (FIG. 13) cross-sectioned ignition groove can be notched on it.

Figure 14:
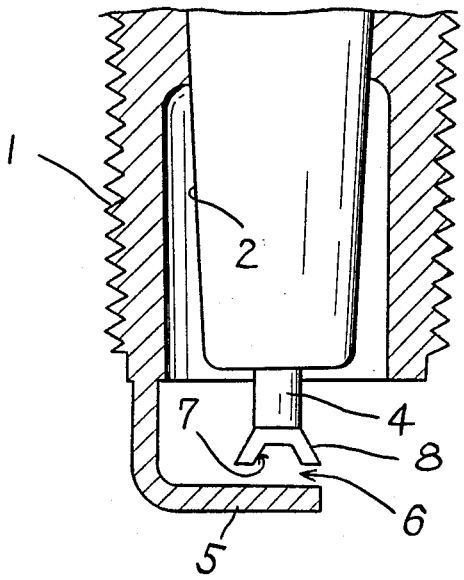
FIGS. 14 through 16 are an elevational view, a side view, and a bottom view of the second example of an ignition plug of this invention.
Figure 15:
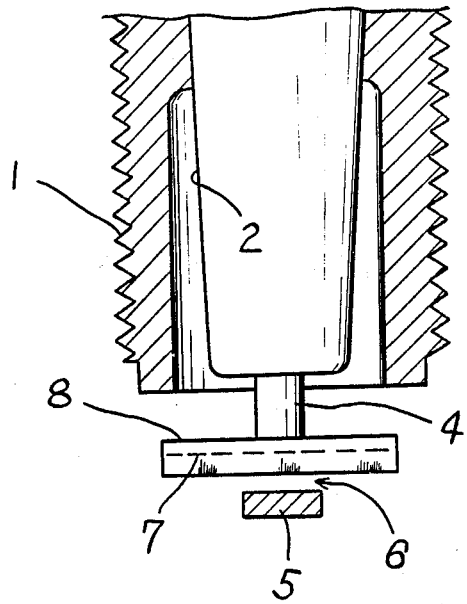
Figure 16:
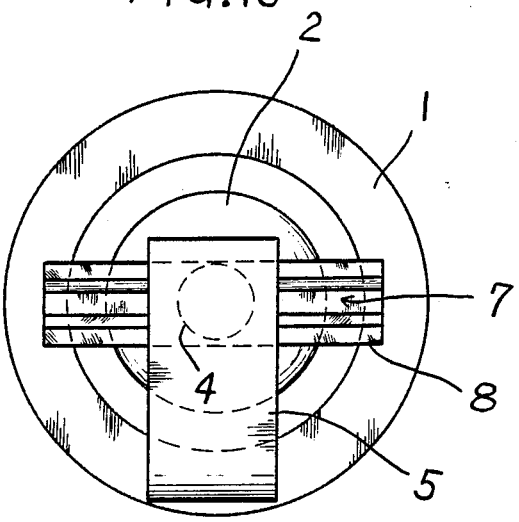

In the second example of an ignition plug of this invention shown in FIGS. 14 through 16, a long straight ignition means 8 is mounted on the top face of the center electrode 4 in a T-form (FIG. 15) in such a way that a frustum shape ignition groove 7 thereof can face the horizontal top portion of the ground electrode 5 which is placed perpendicular to the straight ignition means 8 with a spark spark gap in between.

The configuration of the elements is such in this ignition plug that once first ignition seeds appear in the spark gap 6 by sparks, they keep on setting on fire gas mixture in the ignition groove 7 up to both the ends, successively bouncing on the ground electrode 5. On account of that, gas mixture can take fire in a moment even by a single ignition seed, by which the time before combustion can be reduced.

Figure 17:
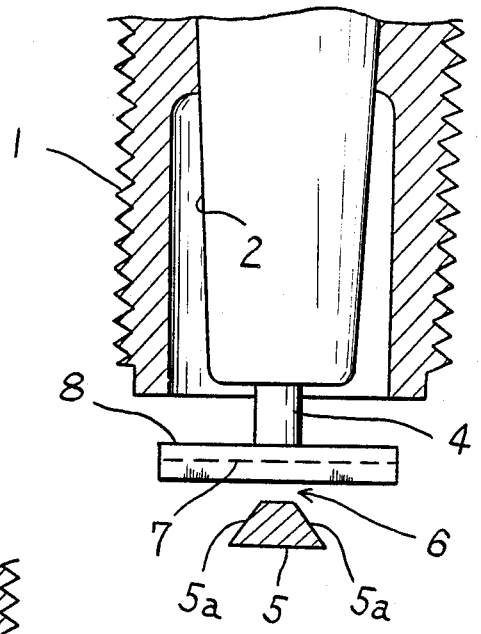
FIGS. 17 through 19 are an elevational view of modifications of the second example.
Figure 18:
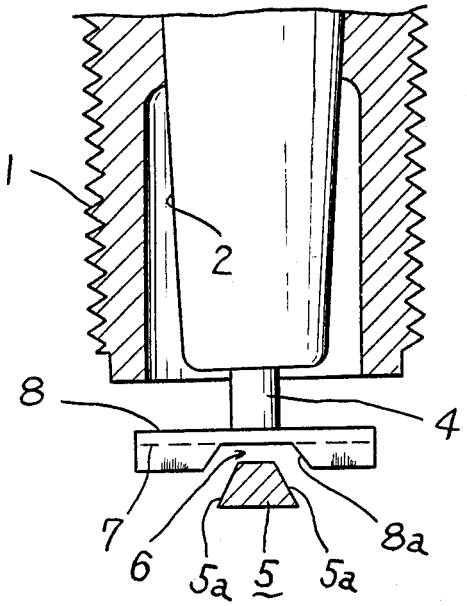
Figure 19:
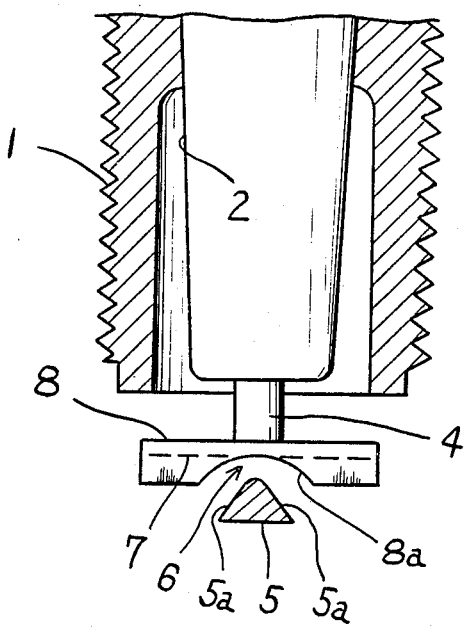

Modifications of the second example are shown in FIGS. 17 through 19. In these modifications, both the longitudinal edges of the horizontal top portion of the ground electrode 5 are chamfered 5*a*, 5*a* in such a way as to make the lateral cross-section of that ground electrode a frustum shape, as shown in FIG. 17. By this modification, first ignition seeds formed in the spark gap 6 can bounce on the chamfered faces 5*a*, 5*a* so as to jump into the opening of the ignition groove 7 of the ignition means 8 mounted on the top face of the center electrode 4.

Also, about half of the ignition means 8 near the ground electrode 5 can be scooped in a frustum shape 8*a* (FIG. 18) or circular shape 8*a* (FIG. 19), corresponding to the frustum shape of round-apexed V-shape cross-section of the ground electrode. In these kinds of embodiment, the ignition groove 7 and the inclined faces 5*a*, 5*a* or 8*a*, 8*a* are designed to introduce first ignition seeds in the ignition groove as effectively as possible, taking advantage of their bouncing on the inclined faces in order to cause instantaneous combustion.

Figure 20:
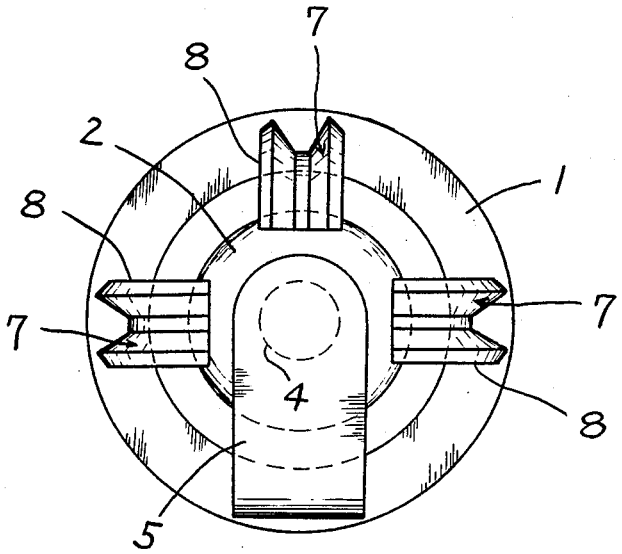
FIG. 20 is a bottom view of another modification of the first example.

A modification of the first example is shown in FIG. 20, wherein the free end of the ground electrode 5 is formed into a circular shape around the axial line of the center electrode 4. This modification makes the distance of the free end of the ground electrode 5 to each end of the ignition grooves 7 of the ignition means 8 equal, and thereby the time before combustion comes to be almost the same in each ignition groove 7.

Figure 21:
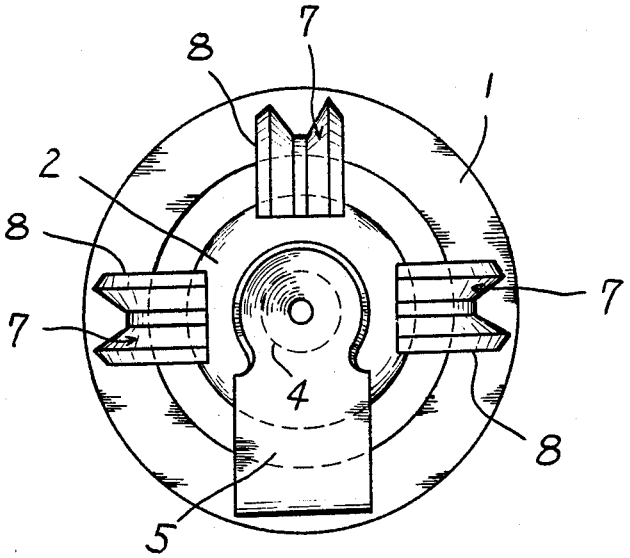
FIGS. 21 and 22 are a bottom view and an elevational view of still another modification of the first example.
Figure 22:
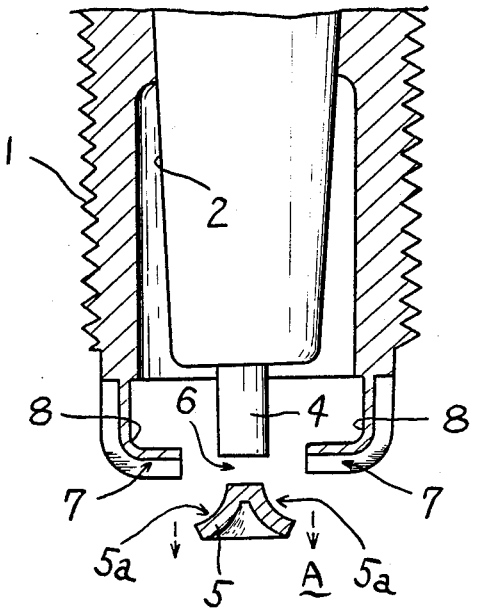

Another modification of the first example is shown in FIGS. 21 and 22. In this modification, the circular free end of the ground electrode 5 is formed into a hollow trumpet form with its bottom lying on the piston side A, as shown in FIG. 22. The inclined face 5*a* thus produced around the axial line of the center electrode 4 makes first ignition seeds appearing in the spark gap 6 bounce on it not only at the same time but also in the same way before they enter the ignition grooves 7 of the ignition means 8, and cause very strong combustion as a whole.

Figure 23:
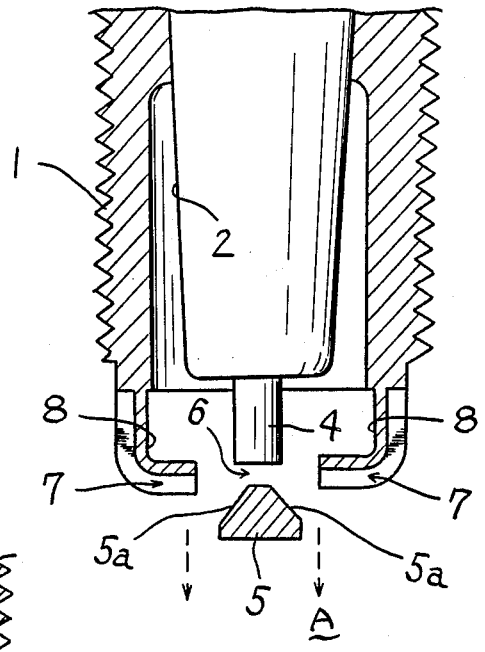
FIGS. 23 and 24 are an elevational view of still further modifications of the first example.
Figure 24:
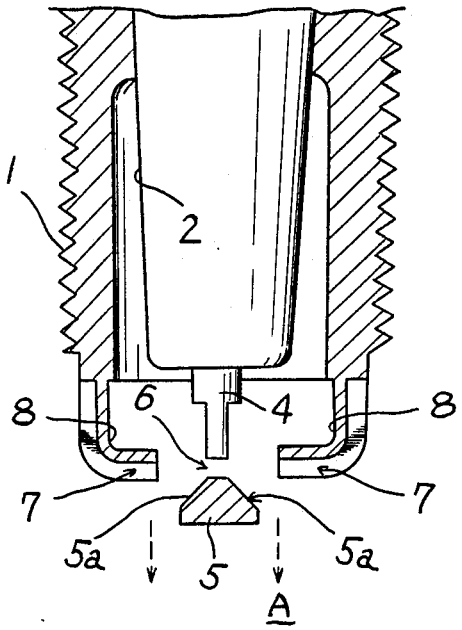

A still further modification of the first example is shown in FIGS. 23 and 24. In this example, a face on the horizontal top portion of the ground electrode 5, parallel to the top face of the center electrode 4, is made as narrow as possible in order that there may appear sparks on the face as nearest to the axial line of the center electrode as possible.

As shown in FIG. 24, the top portion of the center electrode 4 can also be made as small as possible in diameter, compared with the diameter of the foot portion thereof, in order that there may appear sparks on that top as nearest to the axial line of the center electrode as possible.

This modification is constructed such that once sparks are generated int he very limited area of the spark gap 6 nearby the axial line of the center electrode 4, first ignition seeds jump into each opening of the ignition grooves 7 of the ignition means 8 to ignite gas mixture there in the same moment.

What the inventors claim is:

1. An ignition plug for use in an internal combustion engine comprising a metal casing, a cylindrical high tension center electrode axially disposed in the metal casing, a ground electrode extending from the casing, said ground electrode having a substantially L-shape with a first leg extending substantially axially from the metal casing and a second leg having a free end extending radially inward and axially spaced from a terminal end of the center electrode to define a spark gap, said second leg having a length and width greater than a diameter of the center electrode; a plurality of substantially L-shaped ignition means having a first leg extending axially from the metal casing and a second leg extending radially inward toward said center electrode and having a free end radially spaced from the center electrode, wherein said ignition means is provided with an ignition groove on an outer surface opposite the center electrode and said ignition groove defining an axis directed toward the spark gap, and wherein the spaces between the free end of the ignition means and the center electrode are equal and wherein each space between the free end of the ignition means and the center electrode is greater than the spark gap.

2. The ignition plug of claim 1 wherein the ignition means further includes a chamfered outer edge cooperating with the ignition groove.

3. The ignition plug of claim 1 wherein the ground electrode has a chamfered edge facing an ignition groove of the ignition means.

4. The ignition plug of claim 1 wherein the ignition means has a substantially V-shaped cross section.

5. The ignition plug of claim 1 wherein the ignition means has a substantially semi-circular cross-section.

6. The ignition plug of claim 1 wherein the ignition means has a substantially square cross-section and a frustum-shaped ignition groove.

7. The ignition plug of claim 1 wherein the ignition means has a substantially square cross-section and a V-shaped ignition groove.

8. The ignition plug of claim 1 wherein the ignition means has a substantially square cross-section and a semi-circular shaped ignition groove.

9. The ignition plug of claim 3 wherein the free end of the ground electrode is semi-circular shaped.

10. The ignition plug of claim 1 wherein the free end of the ground electrode has a substantially hollow trumpet-shaped cross section having an open end directed away from the center electrode.

11. An ignition plug for use in an internal combustion engine comprising;

(a) a metal casing;

(b) A cylindrical high tension center electrode disposed axially in the metal casing;

(c) an L-shaped ground electrode having a first leg extending axially from the metal casing and a second leg extending radially inward at a right angle to an axis of the center electrode and axially spaced from a terminal end of the center electrode;

(d) an ignition means disposed on the end of the center electrode to define a substantially T-shape, said ignition means having a longitudinal ignition groove facing the ground electrode and wherein the ignition means has a longitudinal axis perpendicular to a longitudinal axis of the second leg of the ground electrode and defines a spark gap between the ignition means and the ground electrode.

12. The ignition plug of claim 11 wherein the ground electrode has chamfered edges cooperating with the ignition means.

13. The ignition plug of claim 12 wherein the ignition means has a transverse recess having a frustum shape corresponding essentially to the cross-section shape of the ground electrode.

14. The ignition plug of claim 11 wherein the ground electrode has a substantially triangular cross-section with a rounded apex and wherein the ignition means has a semi-circular transverse recess cooperating with the ground electrode.

* * * * *